US010581205B2

(12) United States Patent
Yang et al.

(10) Patent No.: US 10,581,205 B2
(45) Date of Patent: Mar. 3, 2020

(54) HIGH-FREQUENCY ULTRA-FINE COAXIAL RF CONNECTION MEMBER AS WELL AS HIGH-FREQUENCY ULTRA-FINE COAXIAL RF JUMPER AND RECEPTOR CONNECTOR THEREOF

(71) Applicant: HARUMOTO TECHNOLOGY (SHEN ZHEN) CO., LTD., Shenzhen (CN)

(72) Inventors: Chang-Fa Yang, Taipei (TW); Hsin-Fu Li, New Taipei (TW); Ming-Jie Goa, Taichung (TW)

(73) Assignee: HARUMOTO TECHNOLOGY (SHEN ZHEN) CO., LTD., Shenzhen (CN)

( * ) Notice: Subject to any disclaimer, the term of this patent is extended or adjusted under 35 U.S.C. 154(b) by 0 days.

(21) Appl. No.: 16/104,769

(22) Filed: Aug. 17, 2018

(65) Prior Publication Data

US 2019/0058291 A1 Feb. 21, 2019

(30) Foreign Application Priority Data

Aug. 17, 2017 (CN) ..... 2017 1 0708304

(51) Int. Cl.

| | |
|---|---|
| ***H01R 13/6594*** | (2011.01) |
| ***H01R 13/639*** | (2006.01) |
| *H01R 12/75* | (2011.01) |
| *H01R 12/71* | (2011.01) |
| *H01R 103/00* | (2006.01) |

(Continued)

(52) U.S. Cl.
CPC ..... *H01R 13/6594* (2013.01); *H01R 13/639* (2013.01); *H01R 9/0515* (2013.01); *H01R 9/0518* (2013.01); *H01R 12/716* (2013.01); *H01R 12/75* (2013.01); *H01R 24/50* (2013.01); *H01R 2103/00* (2013.01)

(58) Field of Classification Search
CPC ..... H01R 13/6594; H01R 9/0515; H01R 9/0518; H01R 12/716; H01R 12/75; H01R 24/50; H01R 2103/00; H01R 9/05
USPC ..... 439/63, 578, 581, 582, 620.03
See application file for complete search history.

(56) References Cited

U.S. PATENT DOCUMENTS 3,980,382 A * 9/1976 Reeder ..... H01R 9/0515 439/581
5,437,562 A * 8/1995 Michael ..... H01R 9/0515 439/581

(Continued)

FOREIGN PATENT DOCUMENTS

JP 2017004703 A * 1/2017

*Primary Examiner* — Travis S Chambers
(74) *Attorney, Agent, or Firm* — Chun-Ming Shih

(57) ABSTRACT

A high-frequency ultra-fine coaxial RF connection member as well as the high-frequency ultra-fine coaxial RF jumper and the receptor connector thereof deliver a high-frequency RF signal by direct electrical contact of an end of a cable central conductor of a coaxial cable with a circuit substrate. Furthermore, the receptor connector of the high-frequency ultra-fine coaxial RF connection member limits a cable end connector through a receptor metal cover, thereby reducing an entire height of the high-frequency ultra-fine coaxial RF connection member, to meet requirement of thinned high-frequency ultra-fine coaxial RF connection members.

6 Claims, 14 Drawing Sheets

(51) Int. Cl.
*H01R 9/05* (2006.01)
*H01R 24/50* (2011.01)

(56) References Cited

U.S. PATENT DOCUMENTS

| | | | | | |
|---|---|---|---|---|---|
| 5,482,477 | A * | 1/1996 | Michael | H01R 9/0515 | 439/108 |
| 6,372,990 | B1 * | 4/2002 | Saito | H01R 9/0515 | 174/74 R |
| 8,939,794 | B2 * | 1/2015 | Mason | H01R 9/0515 | 439/581 |
| 9,160,151 | B2 * | 10/2015 | Vinther | H01R 9/032 | |
| 9,318,835 | B2 * | 4/2016 | Chen | H01R 13/627 | |
| 2016/0164199 | A1 * | 6/2016 | Hashimoto | H01R 24/38 | 439/578 |

* cited by examiner

HIGH-FREQUENCY ULTRA-FINE COAXIAL RF CONNECTION MEMBER AS WELL AS HIGH-FREQUENCY ULTRA-FINE COAXIAL RF JUMPER AND RECEPTOR CONNECTOR THEREOF

CROSS-REFERENCE TO RELATED APPLICATIONS

This application claims the priority of China Patent Application No. 201710708304.7 filed on Aug. 17, 2017, in the State Intellectual Property Office of the China, the disclosure of which is incorporated herein by reference.

BACKGROUND OF THE INVENTION

Field of the Invention

The present invention relates to a high-frequency ultra-fine coaxial RF connection member, and more specifically to a high-frequency ultra-fine coaxial RF connection member as well as the high-frequency ultra-fine coaxial RF jumper and the receptor connector thereof.

Descriptions of the Related Art

In recent years, ultra-fine coaxial RF connection members have been widely used in various electronic products. Generally, antenna modules of mobile communication devices are constituted by ultra-fine coaxial RF connection members, which are all mated with receptor connectors through cable end connectors of ultra-fine coaxial RF jumpers to transmit RF signals.

For a receptor connector, as shown in FIG. 1, the receptor connector 2 is soldered on a circuit substrate, and a middle portion of a receptor connector 2 is provided with a columnar receptor central terminal 21 and a cylindrical receptor shielding terminal 23. The receptor shielding terminal 23 is arranged around the receptor central terminal 21. A bottom side of the receptor central terminal 21 is extended out of a receptor central terminal pin 22. A bottom side of the receptor shielding terminal 23 is extended out of a receptor shielding terminal pin 24. These pins 22, 24 are connected onto designated locations of the circuit substrate by SMT soldering or other connection approaches in use.

For a cable end connector, as shown in FIG. 2, the cable end connector 3 includes a cable end central terminal 31 and a cable end shielding terminal 32, the cable end central terminal 31 being in electrical communication with a cable central conductor (i.e., known as a core wire) of a coaxial cable, the cable end shielding terminal 32 being in electrical communication with an external conductor (not shown) of the coaxial cable. The cable end connector 3 may be mated to the receptor connector 2 as shown in FIG. 1 for the cable end central terminal 31 and the receptor central terminal 21 to be in electrical communication with each other, and for the cable end shielding terminal 32 and the receptor shielding terminal 23 to be in electrical communication with each other, in order for the coaxial cable to be in communication with a RF signal of the circuit substrate.

With respect to a mating process of an existing cable end connector and a receptor connector, as shown in FIG. 3, the cable end connector 3 moves downwards to mate the receptor connector 2. With an interference force (also known as a mating force) generated due to contact between the receptor connector 2 and the cable end connector 3, the mating between the cable end connector 3 and the receptor connector 2 is maintained (refer to FIG. 4).

However, with the requirement of thinned mobile communication devices in recent years, entire heights of a cable end connector and a receptor connector used in conjunction therewith are requested to be reduced constantly. For example, the entire heights of the cable end connector and the receptor connector have been reduced from original 3.5 mm to 1.2 mm, and further, below 1.0 mm. Even more, there is a request of 0.60 mm, which is a height the same as that of other components. Although smaller entire heights of a cable end, a receptor connectors meet the trend of thinned electronic products, it will result in an insufficient mating force between the connectors due to an insufficient contact area (i.e., an insufficient interference height) between the cable end, receptor connectors, such that the cable end connector is detached from the receptor connector due to an external impact, thereby influencing normal operation of electronic products, and even damaging the electronic products. This results in an extreme difficulty for design of an ultra-fine coaxial RF connection member.

Furthermore, existing ultra-fine coaxial RF connection members are limited to poor shielding effect of structural design. As shown in FIG. 3, the cable end shielding terminal 32 has a hole 321, which results in the poor shielding effect, and can only be used to transmit a RF signal in a band below 6 GHz, such as GPS or WiFi. However, according to the WiGig specification for 5G, which is scheduled to be introduced comprehensively in 2020, all high-frequency signals from the band of 15 GHz to the band of 55-67 GHz will be used for RF signals, and even more, UHF RF signals in the band of 80 GHz will be used for automatic navigation of vehicles.

Therefore, it is necessary and urgent to develop an ultra-fine coaxial RF connection member capable of entire height reduction and of transmission over the band above 15 GHz or even the band above 67 GHz.

SUMMARY OF THE INVENTION

In view of the above drawbacks in the conventional technology, the present invention is to provide a high-frequency ultra-fine coaxial RF connection member including a coaxial cable, a cable end connector, a receptor connector and a circuit substrate. The coaxial cable has a cable central conductor and a cable shielding conductor, wherein the cable central conductor and the cable shielding conductor being electrically isolated from each other, the cable central conductor having a cable central conductor body and a cable central conductor end contact part, the cable central conductor end contact part being provided on an end of the cable central conductor body. The cable end connector has a cable end insulator and a cable end shielding terminal, wherein the cable central conductor body penetrates the cable end insulator, and the cable central conductor end contact part extends out of the cable end insulator; the cable end shielding terminal comprises a cable end shielding conductor crimping part, the cable end shielding conductor crimping part crimping the cable shielding conductor and being in electrical contact with the cable shielding conductor. The receptor connector has a receptor insulator, a receptor shielding terminal and a receptor metal cover, wherein the receptor insulator has a first receptor penetration slot and a second receptor penetration slot in communication with each other; the receptor shielding terminal has a first receptor shield and a second receptor shield, the first receptor shield being provided on a slot wall of the first receptor penetration slot to provide electrical shielding for the first receptor penetration slot; the second receptor shield is provided on a slot wall of the second receptor penetration slot, and is in electrical contact with the cable end shielding conductor crimping part to, together with the cable end shielding conductor crimping part, provide electrical shielding for the first receptor penetration slot where the first, the second receptor penetration slots are in communication with each other; and the receptor metal cover has a receptor metal cover body, a receptor cover raise structure and a receptor cover fastening structure, the receptor cover raise structure can lift the receptor metal cover body for the cable central conductor end contact part to be capable of penetrating into the first receptor penetration slot, and for the cable end shielding conductor crimping part to be capable of penetrating into the second receptor penetration slot, the receptor cover fastening structure can fasten the receptor insulator or the receptor shielding terminal for the receptor metal cover body to be in electrical contact with the receptor shielding terminal. The circuit substrate has a substrate core wire contact part and a substrate shielding loop, the substrate core wire contact part and the substrate shielding loop being electrically isolated from each other, the substrate shielding loop surrounding the substrate core wire contact part, the cable central conductor end contact part being extended toward the substrate core wire contact part, and being in direct electrical contact with the substrate core wire contact part in the first receptor penetration slot, the receptor shielding terminal being in electrical contact with the substrate shielding loop; the cable end shielding terminal being in electrical communication with the receptor shielding terminal, the receptor metal cover body and the substrate shielding loop, respectively, to form a shielding environment, such that the first receptor penetration slot is provided with electrical shielding.

Moreover, the present invention further provides a high-frequency ultra-fine coaxial RF jumper, which transmits a high-frequency RF signal in cooperation with a receptor connector, the receptor connector being provided on a circuit substrate, the circuit substrate comprising a substrate core wire contact part. The high-frequency ultra-fine coaxial RF jumper includes a coaxial cable and a cable end connector. The coaxial cable comprises a cable central conductor and a cable shielding conductor, wherein the cable central conductor and the cable shielding conductor being electrically isolated from each other, the cable central conductor having a cable central conductor body and a cable central conductor end contact part, the cable central conductor end contact part being provided on an end of the cable central conductor body. The cable end connector has a cable end insulator and a cable end shielding terminal, wherein the cable central conductor body penetrates the cable end insulator, and the cable central conductor end contact part extends out of the cable end insulator for electrical contact with the substrate core wire contact part; the cable end shielding terminal comprises a cable end shielding conductor crimping part, the cable end shielding conductor crimping part crimping the cable shielding conductor and being in electrical contact with the cable shielding conductor.

Furthermore, the present invention further provides A receptor connector in cooperation with at least one said high-frequency ultra-fine coaxial RF jumper, the circuit substrate further comprising a substrate shielding loop, the substrate core wire contact part and the substrate shielding loop being electrically isolated from each other, the substrate shielding loop surrounding the substrate core wire contact part, wherein the receptor connector includes: a receptor insulator, a receptor shielding terminal and a receptor metal cover, wherein the receptor insulator has a first receptor penetration slot and a second receptor penetration slot in communication with each other; the receptor shielding terminal has a first receptor shield and a second receptor shield, the first receptor shield being provided on a slot wall of the first receptor penetration slot to provide electrical shielding for the first receptor penetration slot; the second receptor shield is provided on a slot wall of the second receptor penetration slot, and is in electrical contact with the cable end shielding conductor crimping part to, together with the cable end shielding conductor crimping part, provide electrical shielding for the first receptor penetration slot where the first, the second receptor penetration slots are in communication with each other; the receptor metal cover has a receptor metal cover body, a receptor cover raise structure and a receptor cover fastening structure, the receptor cover raise structure can lift the receptor metal cover body for the cable central conductor end contact part to be capable of penetrating into the first receptor penetration slot, and for the cable end shielding conductor crimping part to be capable of penetrating into the second receptor penetration slot, the receptor cover fastening structure can fasten the receptor insulator for the receptor metal cover body to be in electrical contact with the receptor shielding terminal; the cable central conductor end contact part is in electrical contact with the substrate core wire contact part in the first receptor penetration slot, the receptor shielding terminal being in electrical contact with the substrate shielding loop; the cable end shielding terminal is in electrical communication with the receptor shielding terminal, the receptor metal cover body and the substrate shielding loop respectively to form a shielding environment, such that the first receptor penetration slot is provided with electrical shielding.

In comparison to prior arts, for the high-frequency ultra-fine coaxial RF connection member as well as the high-frequency ultra-fine coaxial RF jumper and the receptor connector thereof according to the invention, it mainly omits central terminals of the cable end, receptor connectors, allows an end of the cable central conductor of the coaxial cable to be in direct electrical contact with the circuit substrate without other conductor, and delivers a high-frequency RF signal from the cable central conductor of the coaxial cable to the circuit substrate. Moreover, it is designed for the structure of the high-frequency ultra-fine coaxial RF connection member, to provide a complete shielding environment for transmission of high-frequency RF signals, and avoid degradation of high-frequency RF signals due to electromagnetic coupling interference in transmission, and may even be used for transmission of high-frequency RF signals in the bands of 67 GHz and above. Furthermore, the receptor connector of the high-frequency ultra-fine coaxial RF connection member according to the invention limits a cable end connector through a receptor metal cover, so that an entire height of the receptor connector and the cable end connector used in conjunction therewith may be reduced considerably compared to existing ultra-fine coaxial RF connection members, to meet requirement of thinned ultra-fine coaxial RF connection members.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
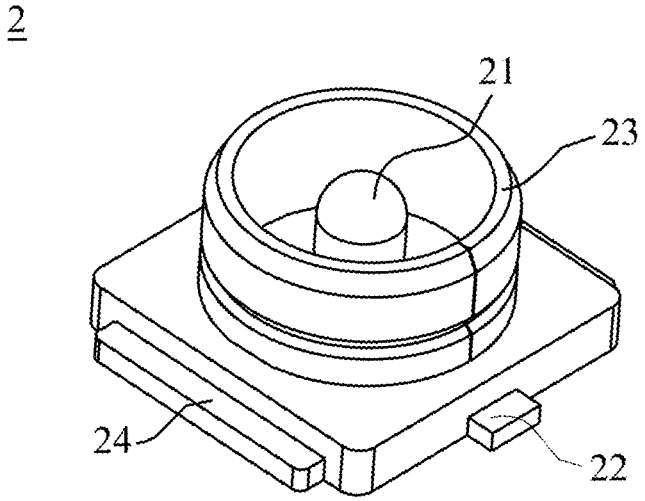
Figure 1 (Prior Art)
FIG. 1 is a schematic view showing a conventional receptor connector.
Figure 2:
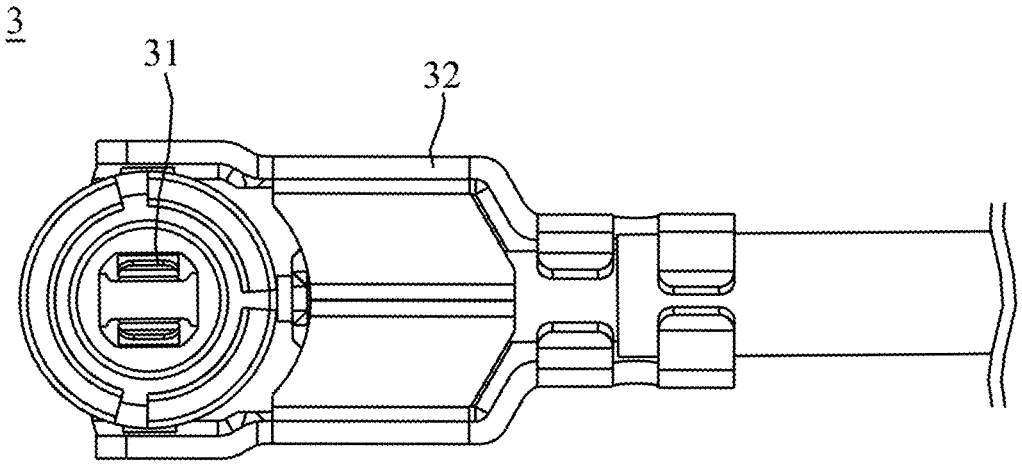
Figure 2 (Prior Art)
FIG. 2 is a schematic view showing a conventional cable end connector.
Figure 3:
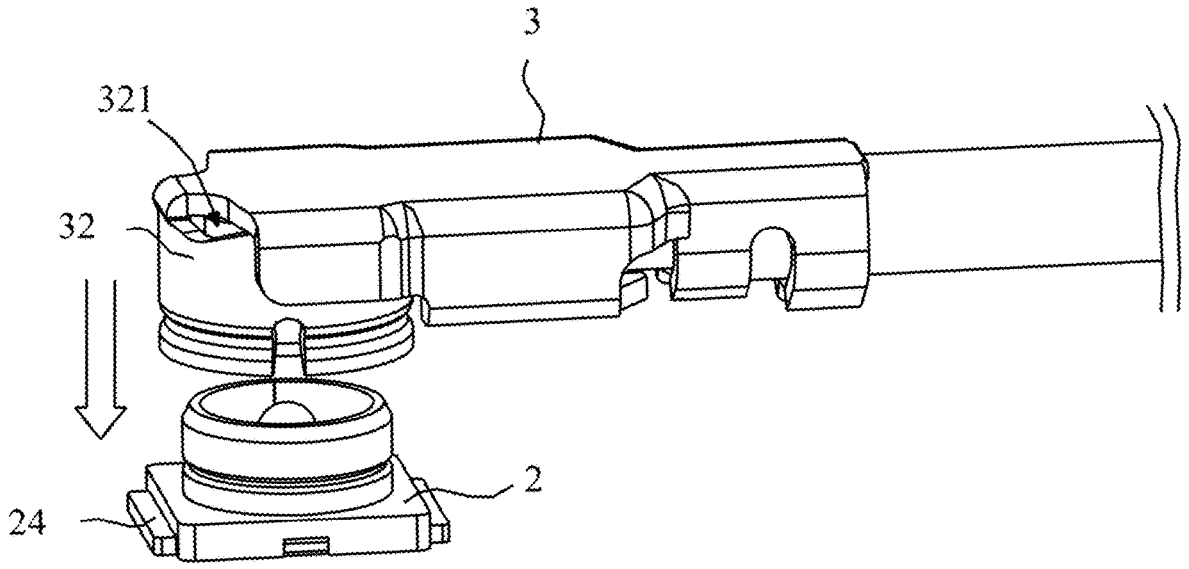
Figure 3 (Prior Art)
FIG. 3 is a schematic view showing a joining action of the cable end connector shown in FIG. 2 and the receptor connector shown in FIG. 1.
Figure 4:
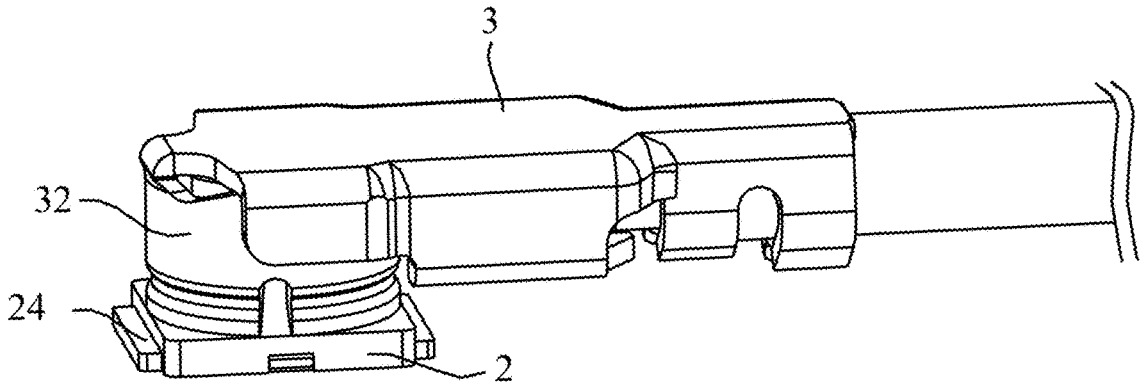
Figure 4 (Prior Art)
FIG. 4 is a schematic view showing a completed joining action of the cable end connector shown in FIG. 2 and the receptor connector shown in FIG. 1.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

In the following, the same or similar functions will be described with the same reference numerals, and descriptions for the same or equivalent features will be omitted in order for the disclosed content to be more concise and to be understood easily.

Figure 11:
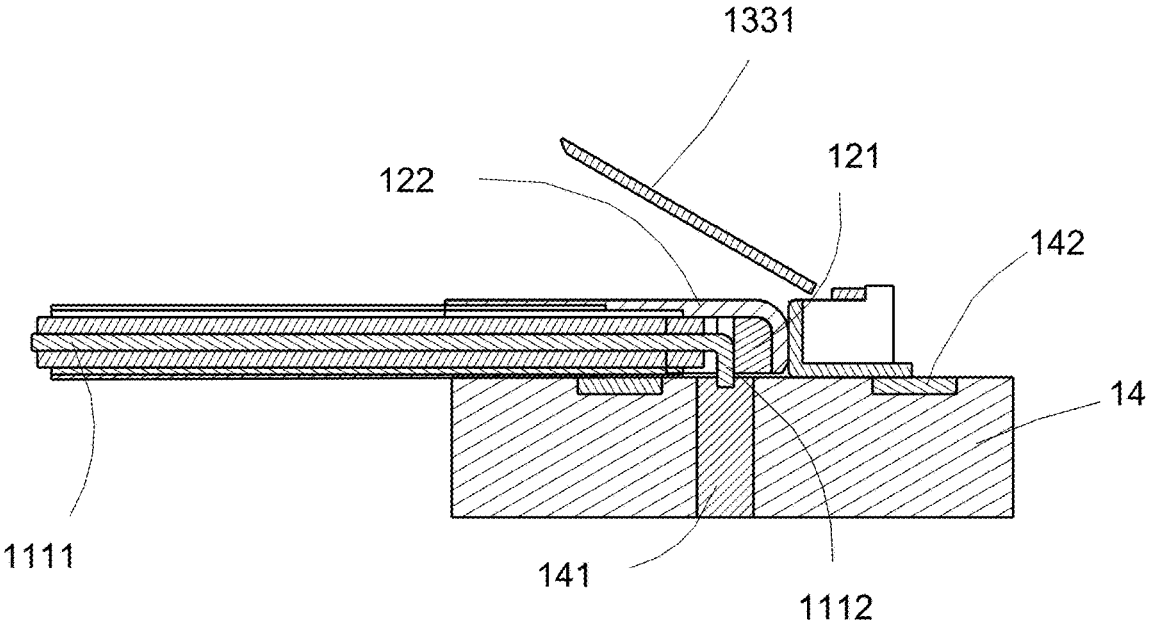
FIG. 11 is a cross-sectional view showing a high-frequency ultra-fine coaxial RF connection member shown in FIG. 10 taken along line AA.

With respect to a technical disclosure according to the invention, referring to FIGS. 5 to 18, as shown in various Figures, a high-frequency ultra-fine coaxial RF connection member 1 includes: a high-frequency ultra-fine coaxial RF jumper 4, a receptor connector 13 and a circuit substrate 14. The high-frequency ultra-fine coaxial RF jumper 4 is consisted at least of a coaxial cable 11 and a cable end connector 12. In the invention, the coaxial cable 11 has a cable central conductor 111 and a cable shielding conductor 112, which are electrically isolated from each other due to an insulation material therebetween, such that the cable shielding conductor 112 can provide electrical shielding for the cable central conductor 111, allowing the cable central conductor 111 to be capable of transmitting high-frequency RF signals. A cable central conductor end contact part 1112 is arranged on an end of a cable central conductor body 1111 of the cable central conductor 111. The cable end connector 12 has a cable end insulator 121 and a cable end shielding terminal 122. In the example shown in FIG. 11, the cable central conductor body 1111 penetrates into a cable end insulator 121, and the cable central conductor end contact part 1112 is extended out of the cable end insulator 121, while an angle between the cable central conductor end contact part 1112 and the cable central conductor body 1111 is approximately 90 degrees, such that there is an L-shape cross section for the cable central conductor 111, and direct electrical contact of the cable central conductor end contact part 1112 with the circuit substrate 14 without other conductor is provided, to reduce degradation during transmission of a high-frequency RF signal to the circuit substrate 14 over the cable central conductor 111. The cable central conductor body 1111 is penetrated into the cable end insulator 121, so that support is required for the cable end insulator 121, to avoid shifting of the cable end insulator 121, which results in deformation and according fracture of the cable central conductor body 1111, or shifting of the cable central conductor end contact part 1112, such that effective and direct electrical contact with the circuit substrate 14 fails, and in turn, transmission of high-frequency RF signals is influenced. Thus, in the example as shown in FIG. 7, the cable end shielding terminal 122 is provided further with a cable end insulator support part 1222, which is extended along an outer wall of the cable end insulator 121 to embrace the cable end insulator 121, such that a rigid support is provided for the cable end insulator 121, which is thus secured, to ensure no fracture for the cable central conductor body 1111, and to ensure that the cable central conductor end contact part 1112 can be in direct electrical contact with the circuit substrate 14.

Figure 16:
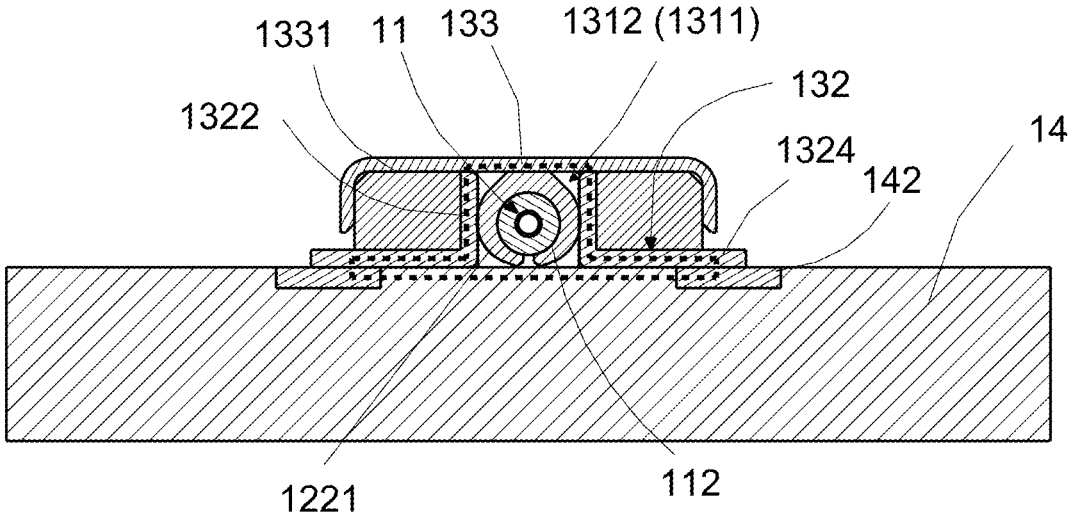
FIG. 16 is a cross-sectional view showing a high-frequency ultra-fine coaxial RF connection member shown in FIG. 13 taken along line DD.
Figure 17:
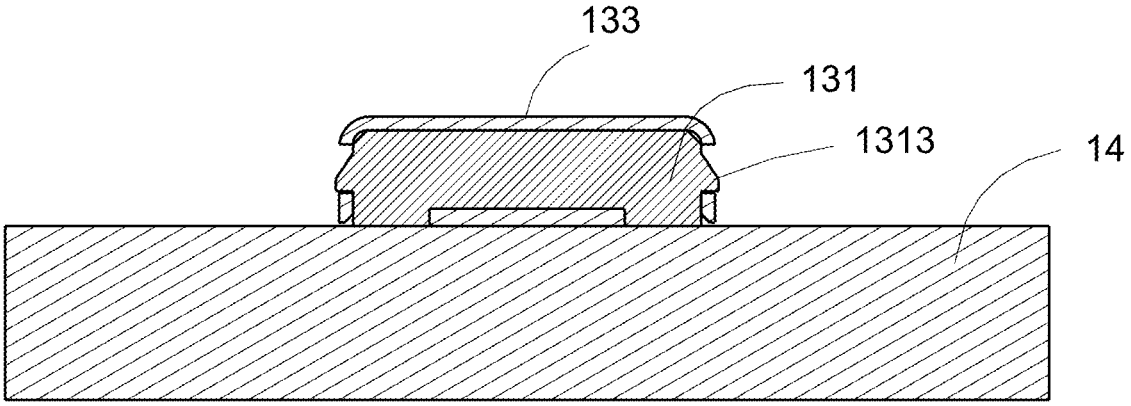
FIG. 17 is a cross-sectional view showing a high-frequency ultra-fine coaxial RF connection member shown in FIG. 13 taken along line EE.
Figure 18:
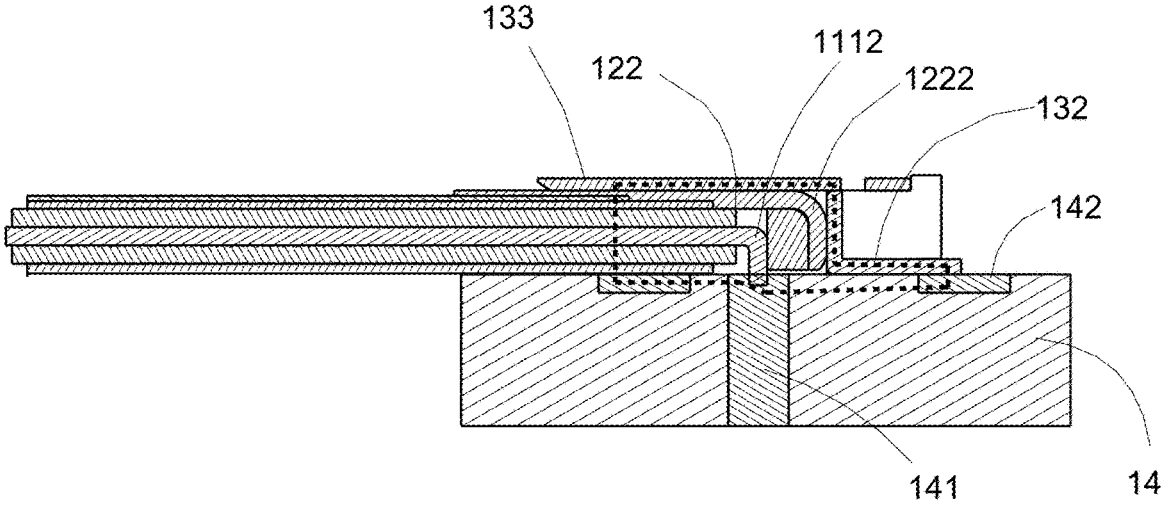
FIG. 18 is a cross-sectional view showing a high-frequency ultra-fine coaxial RF connection member shown in FIG. 13 taken along line FF.

In the example as shown in FIG. 16, the cable end shielding terminal 122 comprises a cable end shielding conductor crimping part 1221, which crimps the cable shielding conductor 112 of the coaxial cable 11, and is in direct electrical contact with the cable shielding conductor 112 of the coaxial cable 11, for the cable end shielding terminal 122 to be in electrical communication with the cable shielding conductor 112 of the coaxial cable 11. As such, the coaxial cable 11 and the cable end connector 12 according to the invention may constitute a high-frequency ultra-fine coaxial RF jumper 4 as shown in FIG. 6 in cooperation with the receptor connector 13, transmit a high-frequency RF signal via direct electrical contact of the cable central conductor 111 of the coaxial cable 11 with the circuit substrate 14, and provide electrical shielding through the cable end shielding terminal 122 for the cable central conductor 111, over which the high-frequency RF signal is transmitted.

For the receptor connector 13, in the example shown in FIGS. 5 to 8, the receptor connector 13 has a receptor insulator 131, a receptor shielding terminal 132 and a receptor metal cover 133. The receptor insulator 131 has a first, a second receptor penetration slots 1311, 1312 in communication with each other. The receptor shielding terminal 132 has a first, a second receptor shields 1321, 1322 provided on slot walls of the first, second receptor penetration slots 1311, 1312, respectively, to provide electrical shielding for the first, second receptor penetration slots 1311, 1312, respectively. The high-frequency ultra-fine coaxial RF jumper 4 provided in the invention may penetrate into the receptor connector 13, for the cable central conductor end contact part 1112 of the coaxial cable 11 to extend toward the circuit substrate 14, and to be in direct electrical contact with the circuit substrate 14 without other conductor in the first receptor penetration slot 1311.

The receptor metal cover 133 has a receptor metal cover body 1331, a receptor cover raise structure 1332 and a receptor cover fastening structure 1333. The receptor cover raise structure 1332 is, for example, a folding structure provided on the receptor metal cover body 1331, which provides folding to lift the receptor metal cover body 1331, for the first, second receptor penetration slots 1311, 1312 of the receptor insulator 131 to be exposed, so that the cable end insulator 121 of the high-frequency ultra-fine coaxial RF jumper 4 and the cable end shielding conductor crimping part 1221 may penetrate into the first, second receptor penetration slots 1311, 1312 downwards, respectively, and in turn, the cable end connector 12 is limited in the receptor connector 13.

Figure 5:
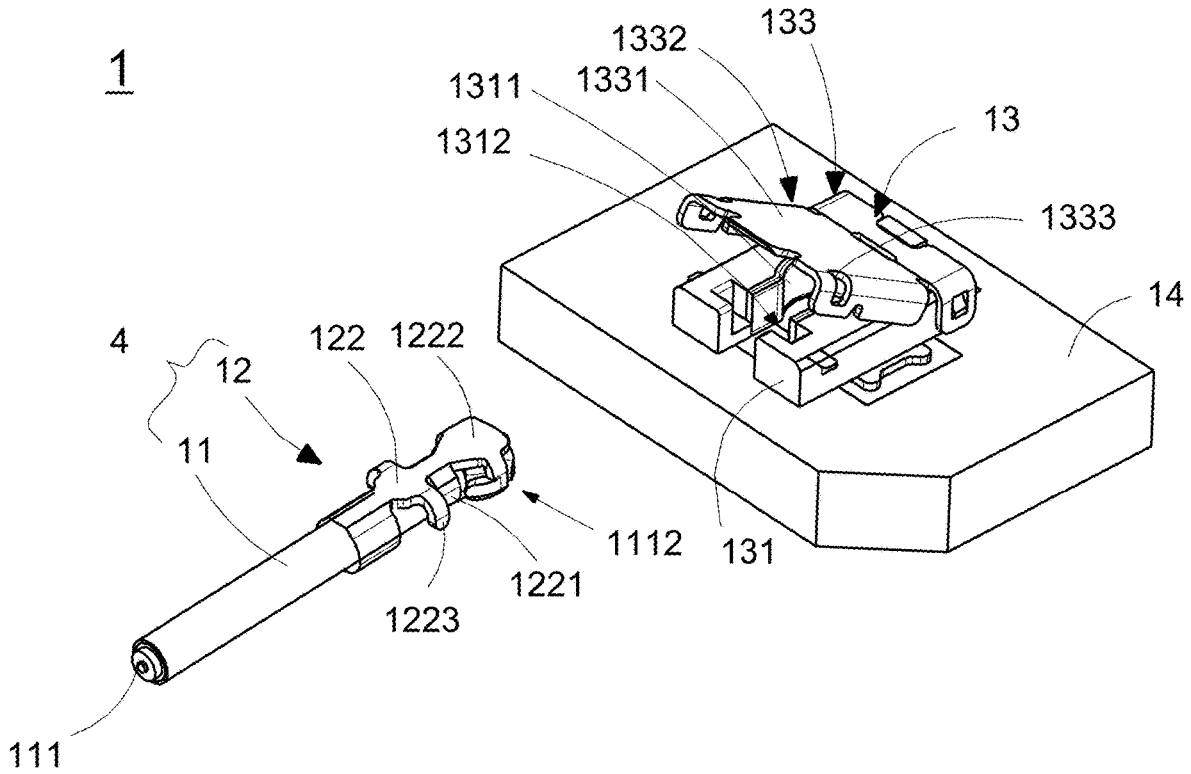
FIG. 5 is a schematic view showing a first usage state of a high-frequency ultra-fine coaxial RF connection member in an example according to the invention.
Figure 6:
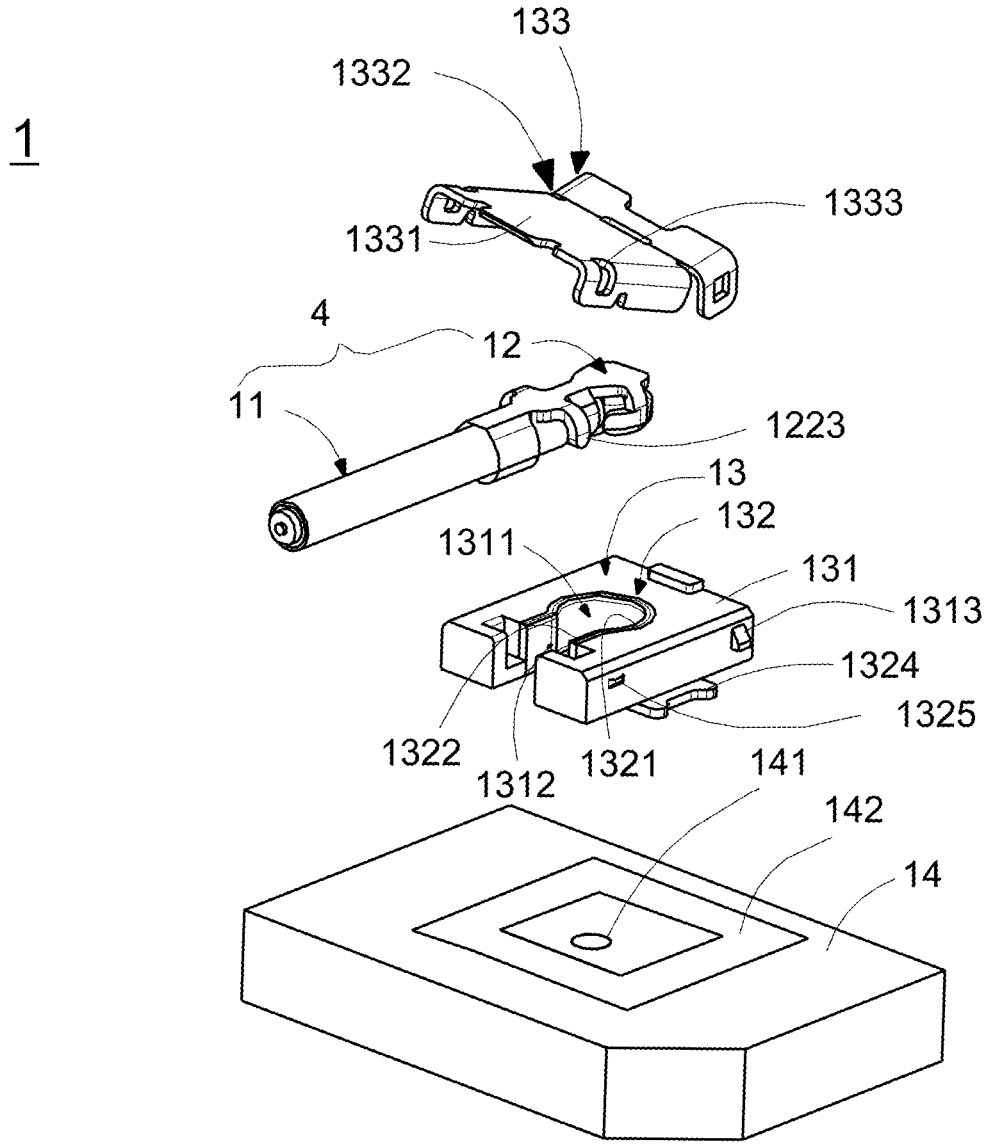
FIG. 6 is an exploded view of a high-frequency ultra-fine coaxial RF connection member shown in FIG. 5.
Figure 7:
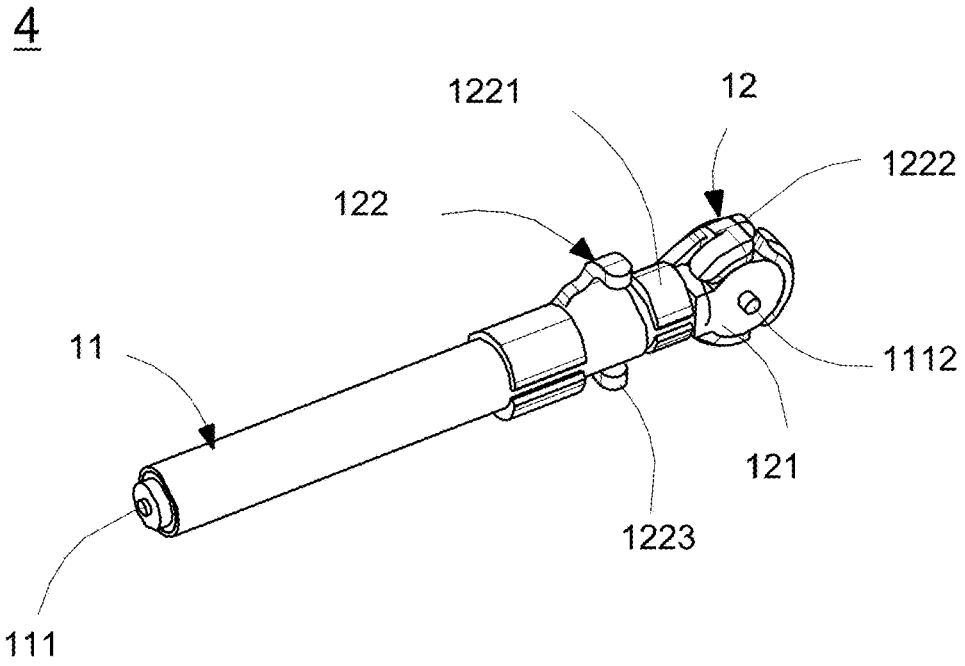
FIG. 7 is a schematic view of the coaxial cable shown in FIG. 5 from an angle of view.
Figure 8:
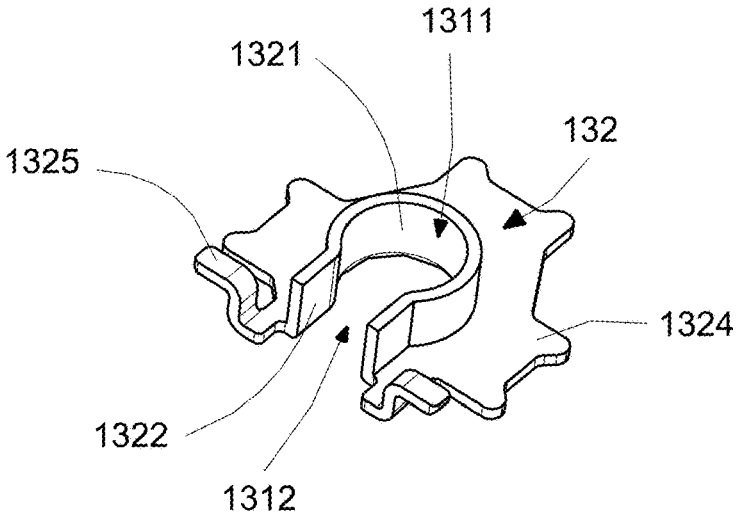
FIG. 8 is a schematic view of a receptor shielding terminal in an example according to the invention.

Thus, in the example as shown in FIGS. 5 to 6, the cable end shielding terminal 122 is further arranged with a cable end wing-like plate 1223, and the cable end wing-like plate 1223 is embedded in the receptor insulator 131 thereby, such that movement of the cable end shielding terminal 122 relative to the receptor insulator 131 is stopped, to prevent the cable end connector 12 from exiting the receptor connector 13 laterally, for ensuring limiting of the cable end connector 12 in the receptor connector 13.

The receptor cover fastening structure 1333 may fasten the receptor insulator 131 or the receptor shielding terminal 132, for the receptor metal cover 133 to be fastened at the receptor connector 13, and may limit the cable end connector 12 in the receptor connector 13 without mating between the cable end connector 12 and receptor connector 13, so that the entire height of the cable end connector 12 and the receptor connector 13 used in conjunction therewith may be reduced considerably compared to existing ultra-fine coaxial RF connection members, in order to meet the requirement of thinned mobile communication devices in recent years.

Correspondingly, in the example as shown in FIG. 6, the receptor insulator 131 and the receptor shielding terminal 132 may be arranged with a receptor insulator fastening structure 1313 and a receptor shielding terminal fastening structure 1325 for fastening the receptor metal cover 133, such as a bump, respectively, for the receptor metal cover 133 to be joined with the receptor insulator 131 and the receptor shielding terminal 132, respectively. It should be noted that, in the example as shown in FIG. 16, as the receptor metal cover 133 is fastened at the receptor connector 13, the receptor metal cover body 1331 is in direct electrical contact with the receptor shielding terminal 132 and the cable end shielding conductor crimping part 1221.

For the circuit substrate 14, a substrate core wire contact part 141 and a substrate shielding loop 142 which are electrical isolated from each other are included. The substrate shielding loop 142 surrounds the substrate core wire contact part 141 to provide a shielding environment for the substrate core wire contact part 141. It should be noted that the cable end connector 12 according to the invention is provided in the first receptor penetration slot 1311, for the cable central conductor end contact part 1112 to extend toward the substrate core wire contact part 141, and penetrate through the first receptor penetration slot 1311 to be in direct electrical contact with the substrate core wire contact part 141 without other conductor. The receptor shielding terminal 132 has a receptor welding leg 1324 and is in direct electrical contact with the substrate shielding loop 142.

Figure 9:
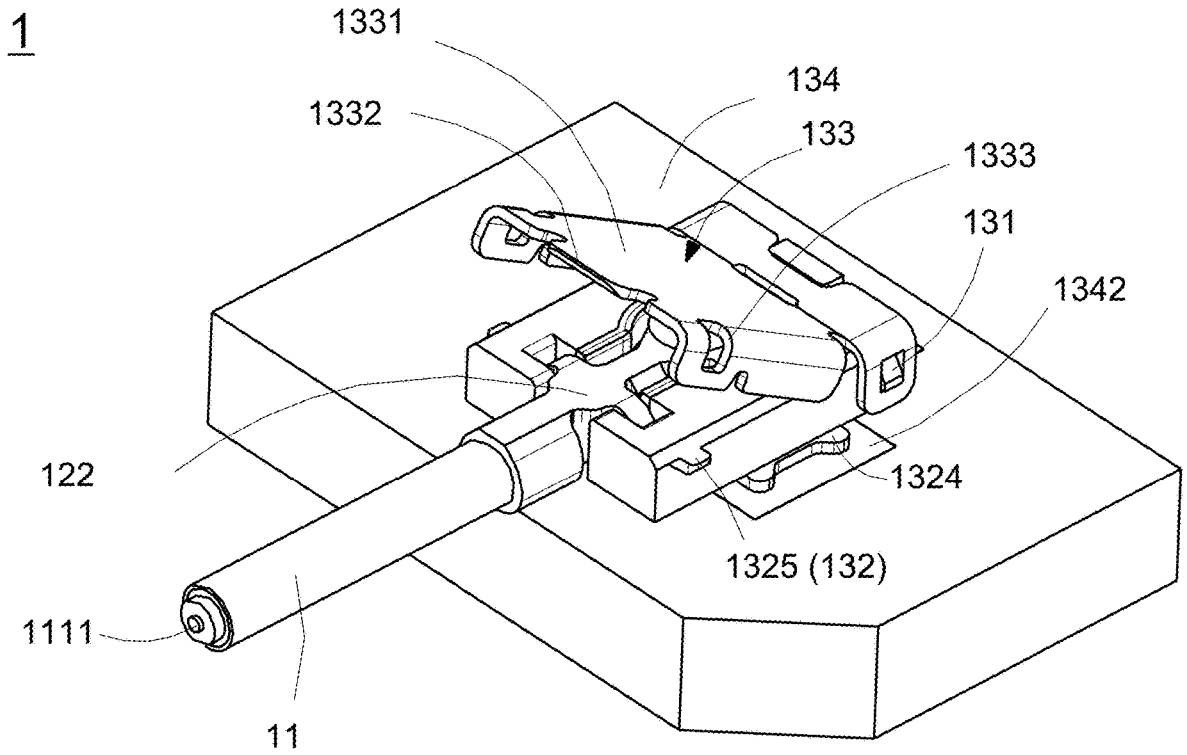
FIG. 9 is a schematic view showing a second usage state of a high-frequency ultra-fine coaxial RF connection member in an example according to the invention.
Figure 10:
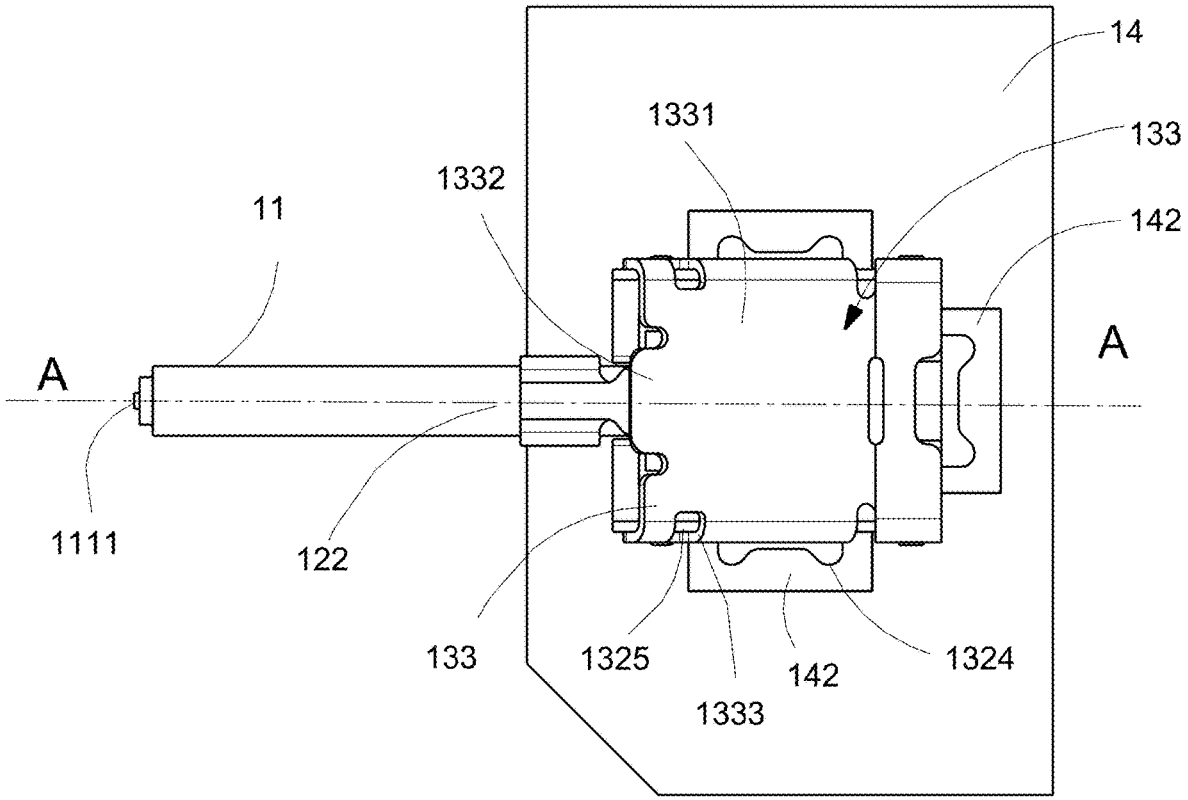
FIG. 10 is a top view of a high-frequency ultra-fine coaxial RF connection member shown in FIG. 9.
Figure 12:
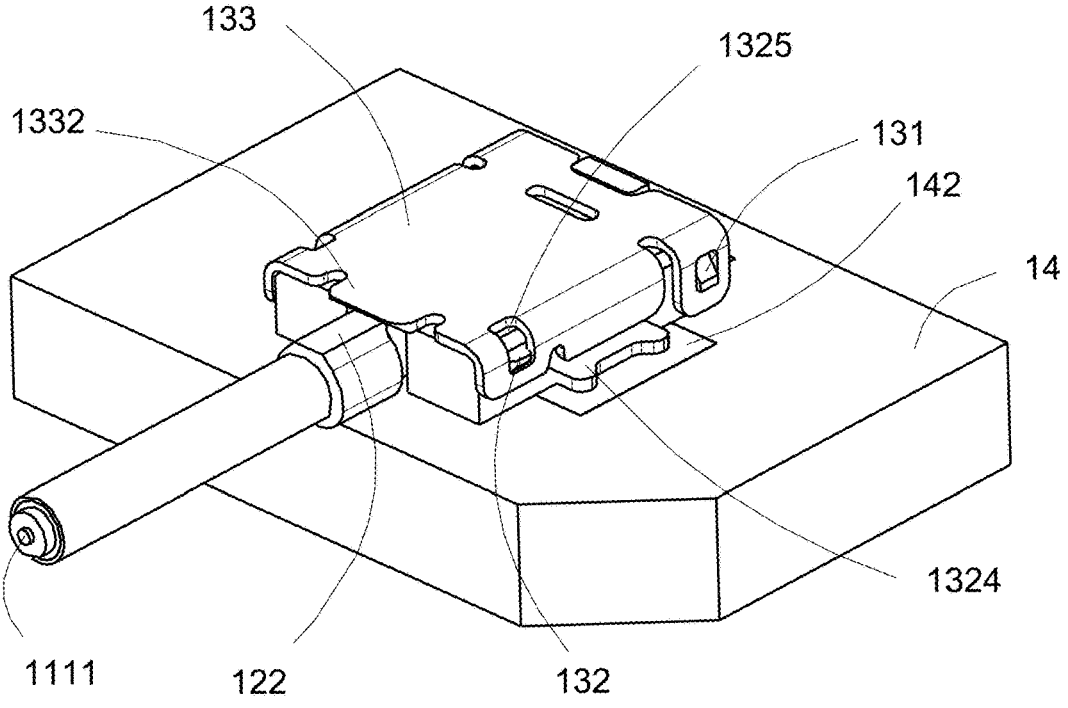
FIG. 12 is a schematic view showing a third usage state of a high-frequency ultra-fine coaxial RF connection member in an example according to the invention.
Figure 13:
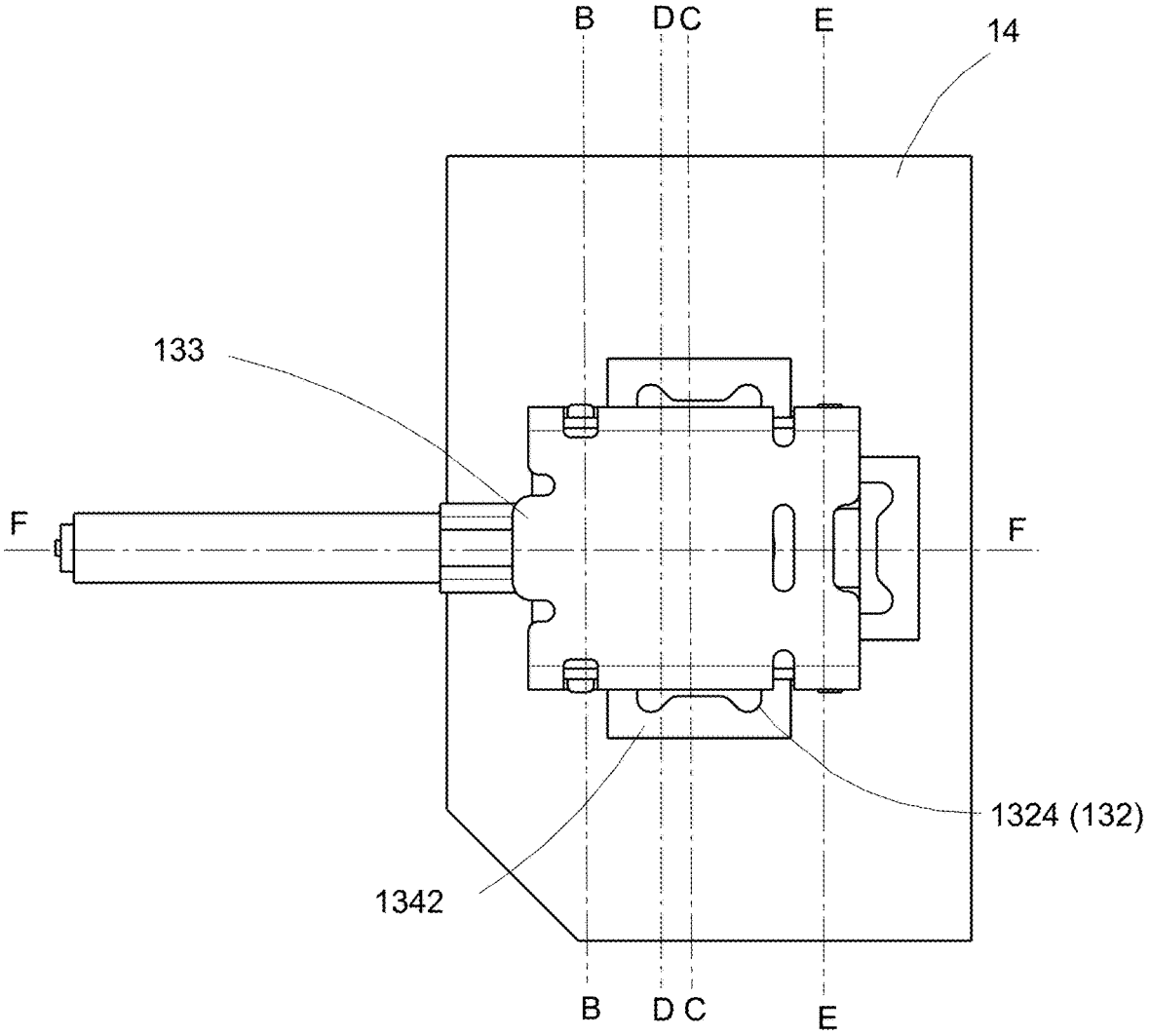
FIG. 13 is a top view of a high-frequency ultra-fine coaxial RF connection member shown in FIG. 12.
Figure 14:
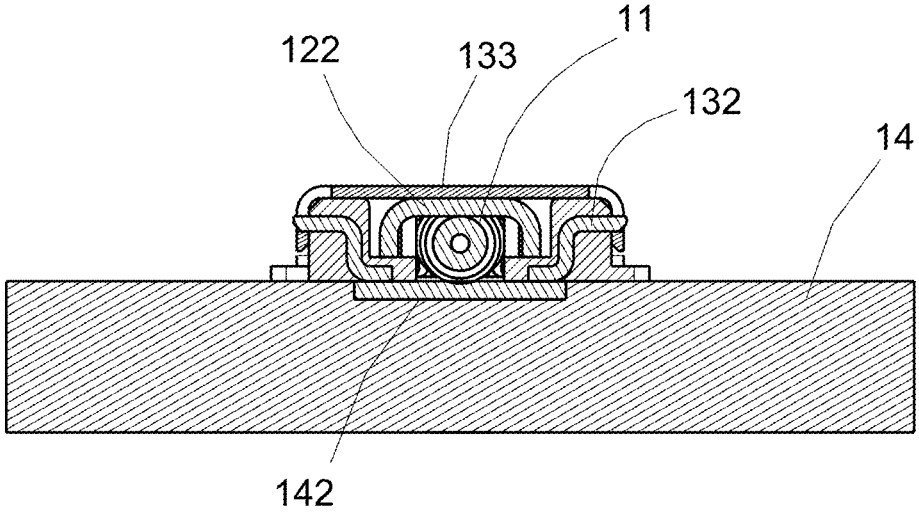
FIG. 14 is a cross-sectional view showing a high-frequency ultra-fine coaxial RF connection member shown in FIG. 13 taken along line BB.

With respect to the high-frequency ultra-fine coaxial RF connection member according to the invention, as shown in FIG. 5, the receptor metal cover body 1331 is in a raise state, for the cable central conductor end contact part 1112 and the cable end shielding conductor crimping part 1221 to be capable of penetrating into the first, second receptor penetration slots 1311, 1312, respectively. As shown in FIGS. 9 and 12, the receptor metal cover 133 may fasten the receptor insulator 131 or the receptor shielding terminal 132, to limit the high-frequency ultra-fine coaxial RF jumper 4 according to the invention.

Figure 15:
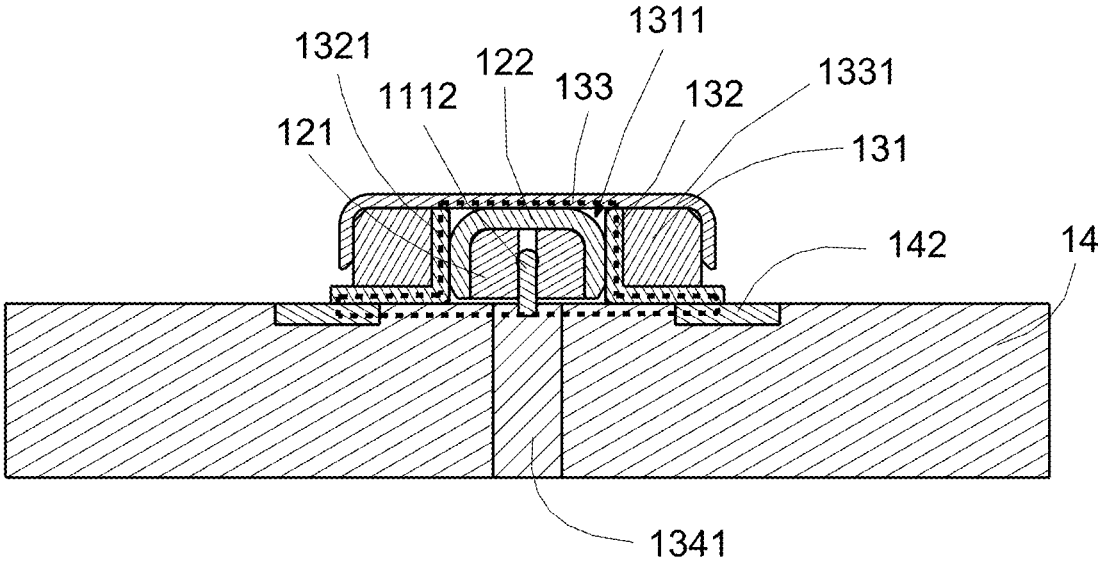
FIG. 15 is a cross-sectional view showing a high-frequency ultra-fine coaxial RF connection member shown in FIG. 13 taken along line CC.

In addition, as shown in FIG. 15, the cable end shielding terminal 122 is in electrical communication with the receptor shielding terminal 132, the receptor metal cover body 1331 and the substrate shielding loop 142, respectively, to form a shielding environment surrounding the first receptor penetration slot 1311 (the shielding environment is indicated with a dashed line in FIG. 15), such that electrical shielding is provided for the first receptor penetration slot 1311, forming a complete shielding framework approximate to the coaxial cable, to avoid electromagnetic coupling interference in the first receptor penetration slot 1311 when a high-frequency RF signal is transmitted via the cable central conductor end contact part 1112.

Furthermore, as shown in FIG. 16, the cable end shielding conductor crimping part 1221 of the cable end connector 12 is in electrical contact with the second receptor shielding conductor 1322, for the second receptor shielding conductor 1322 to be in electrical communication with the cable end shielding conductor crimping part 1221, so that a shielding environment is formed where the first, second receptor penetration slots 1311, 1312 are in communication with each other (the shielding environment is indicated with a dashed line in FIG. 16), to provide electrical shielding for the first receptor penetration slot 1311, and prevent electromagnetic coupling interference in the first receptor penetration slot 1311 when a high-frequency RF signal is transmitted via the cable central conductor end contact part 1112.

Figure 20:
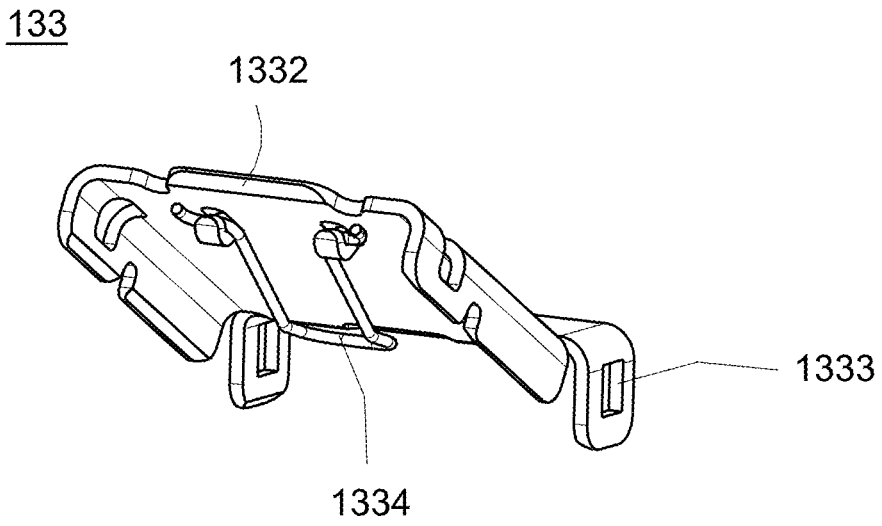
FIG. 20 is a schematic view showing a first example of a receptor metal cover according to the invention.
Figure 21:
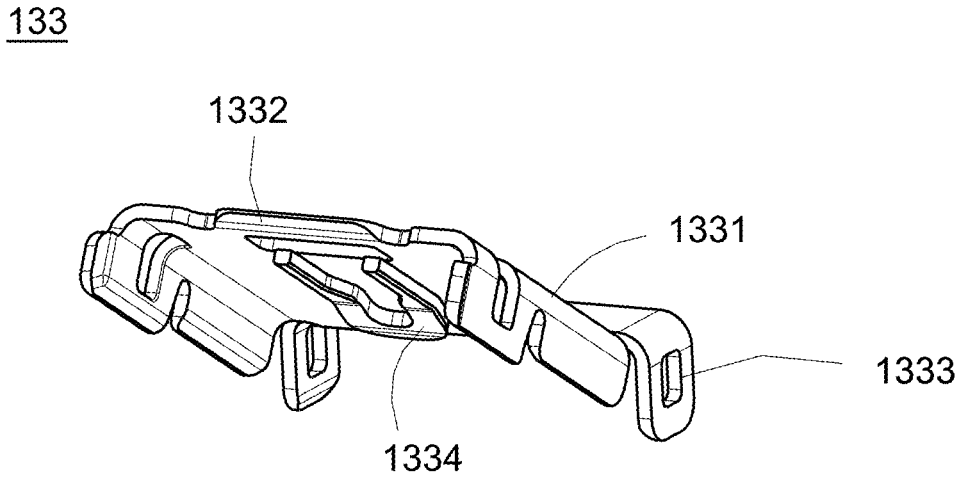
FIG. 21 is a schematic view showing a second example of a receptor metal cover according to the invention.
Figure 22:
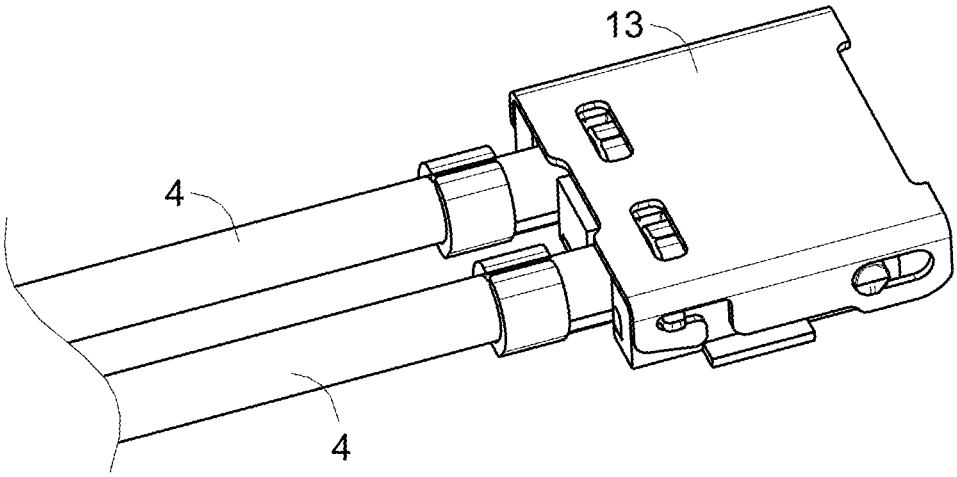
FIG. 22 is a schematic view showing a state in which a receptor connector is in cooperation with multiple high-frequency ultra-fine coaxial RF jumpers according to the invention.
Figure 23:
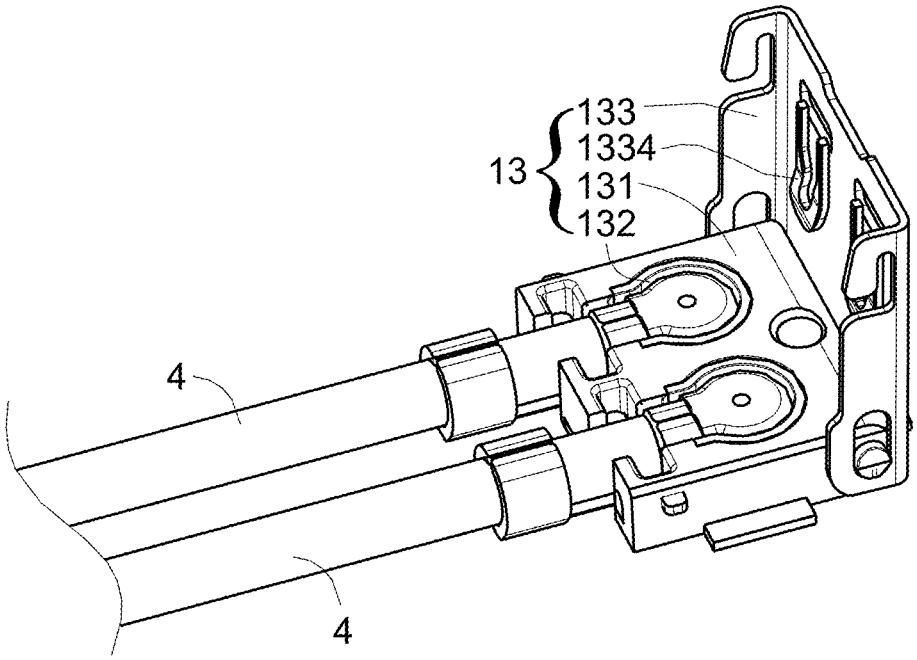
FIG. 23 is an exploded view of members shown in FIG. 22.

Moreover, as shown in FIGS. 20 to 21, the receptor metal cover 133 according to the invention further comprises an elastic structure 1334, which may be a wire spring shown in FIG. 20 or a plate spring shown in FIG. 21. In this example, the elastic structure 1334 of the receptor metal cover 133 is located between the receptor metal cover body 1331 and the receptor shielding terminal 132, such that as the receptor insulator 131 or the receptor shielding terminal 132 is fastened at the receptor cover fastening structure 1333, the receptor metal cover body 1331 and the cable end shielding terminal 122 are in electrical contact with each other, to ensure that a shielding environment is formed in the first receptor penetration slot 1311, and further, an elastic force is provided for forcing electrical contact of the cable central conductor end contact part 1112 with the substrate core wire contact part 141, to ensure that the cable central conductor end contact part 1112 can transmit a high-frequency RF signal to the substrate core wire contact part 141. In addition, as shown in FIGS. 22 to 23, the receptor connector 13 according to the invention may be in cooperation with multiple high-frequency ultra-fine coaxial RF jumpers 4 mentioned above, such that the quantity of the receptor connectors 13 may be reduced to save space in use when it is required to pair multiple receptor connectors 13 and multiple high-frequency ultra-fine coaxial RF jumpers 4.

Figure 19:
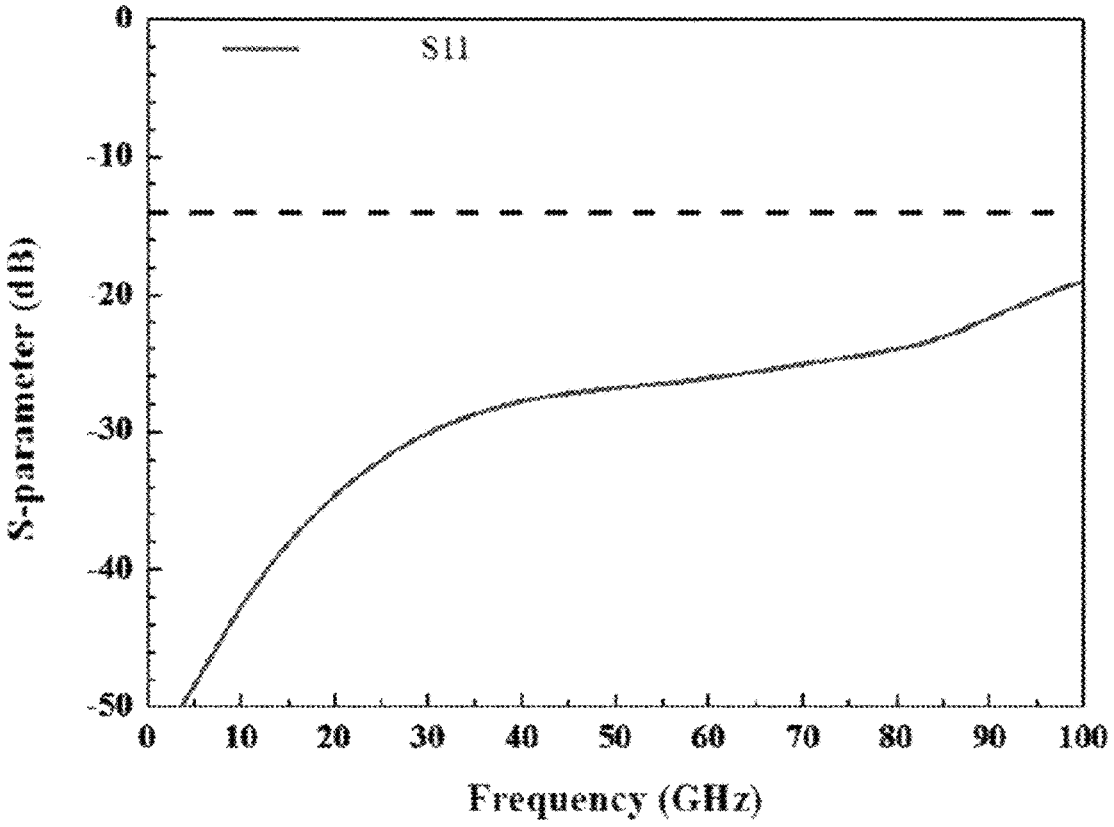
FIG. 19 is a graph of simulation for parameter S11 of a high-frequency ultra-fine coaxial RF connection member in an example according to the invention.

For the effect of transmitting high-frequency RF signals according to the invention, refer to the graph of simulation for parameter S11 a high-frequency RF signal in transmission. Generally, the value of parameter S11 indicates return loss, i.e., the amount of energy reflected back to a source. The smaller the value of parameter S11, the better it is. Currently, in the industry, the value of parameter S11 for transmission of a high-frequency signal in the band of 67 GHz is specified as −10 dB. Thus, from the disclosure according to FIG. 19, during transmission of a high-frequency RF signal in a band of 100 GHz according to the invention, the value of parameter S11 gets even below −20 dB excellently. That is, according to the invention, during transmission of a high-frequency RF signal in a band of 100 GHz, the value of parameter S11 may be controlled below −20 dB. Accordingly, the invention can avoid electromagnetic coupling interference during transmission of high-frequency RF signals effectively in actual, and effects transmission of high-frequency RF signals excellently.

In summary, for the high-frequency ultra-fine coaxial RF connection member as well as the high-frequency ultra-fine coaxial RF jumper and the receptor connector thereof according to the invention, it mainly omits central terminals of the cable end, receptor connectors, allows an end of the cable central conductor of the coaxial cable to be in direct electrical contact with the circuit substrate without other conductor, and delivers a high-frequency RF signal from the cable central conductor of the coaxial cable to the circuit substrate. Moreover, it is designed for the structure of the high-frequency ultra-fine coaxial RF connection member, to provide a complete shielding environment for transmission of high-frequency RF signals, and avoid degradation of high-frequency RF signals due to electromagnetic coupling interference in transmission, and may even be used for transmission of high-frequency RF signals in the bands of 67 GHz and above. Furthermore, the receptor connector of the high-frequency ultra-fine coaxial RF connection member according to the invention limits a cable end connector through a receptor metal cover, so that an entire height of the receptor connector and the cable end connector used in conjunction therewith may be reduced considerably compared to existing ultra-fine coaxial RF connection members, to meet requirement of thinned ultra-fine coaxial RF connection members.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A high-frequency ultra-fine coaxial RF jumper, which transmits a high-frequency RF signal in cooperation with a receptor connector, the receptor connector being provided on a circuit substrate, the circuit substrate comprising a substrate core wire contact part, the high-frequency ultra-fine coaxial RF jumper including:

a coaxial cable comprising a cable central conductor and a cable shielding conductor, the cable central conductor and the cable shielding conductor being electrically isolated from each other, the cable central conductor having a cable central conductor body and a cable central conductor end contact part, an end of the cable central conductor body bending downward to form the cable central conductor end contact part to directly contact the substrate core wire contact part; and a cable end connector having a cable end insulator and a cable end shielding terminal, wherein the cable central conductor body penetrates the cable end insulator, and the cable central conductor end contact part extends out of the cable end insulator for electrical contact with the substrate core wire contact part;

the cable end shielding terminal comprises a cable end shielding conductor crimping part, the cable end shielding conductor crimping part crimping the cable shielding conductor and being in electrical contact with the cable shielding conductor.

2. A receptor connector in cooperation with at least one high-frequency ultra-fine coaxial RF jumper as claim 1, the circuit substrate further comprising a substrate shielding loop, the substrate core wire contact part and the substrate shielding loop being electrically isolated from each other, the substrate shielding loop surrounding the substrate core wire contact part, wherein, the receptor connector includes: a receptor insulator, a receptor shielding terminal and a receptor metal cover, wherein the receptor insulator has a first receptor penetration slot and a second receptor penetration slot in communication with each other;

the receptor shielding terminal has a first receptor shield and a second receptor shield, the first receptor shield being provided on a slot wall of the first receptor penetration slot to provide electrical shielding for the first receptor penetration slot; the second receptor shield is provided on a slot wall of the second receptor penetration slot, and is in electrical contact with the cable end shielding conductor crimping part to, together with the cable end shielding conductor crimping part, provide electrical shielding for the first receptor penetration slot where the first and the second receptor penetration slots are in communication with each other;

the receptor metal cover has a receptor metal cover body, a receptor cover raise structure and a receptor cover fastening structure, the receptor cover raise structure can lift the receptor metal cover body for the cable central conductor end contact part to be capable of penetrating into the first receptor penetration slot, and for the cable end shielding conductor crimping part to be capable of penetrating into the second receptor penetration slot, the receptor cover fastening structure can fasten the receptor insulator for the receptor metal cover body to be in electrical contact with the receptor shielding terminal; wherein, the cable central conductor end contact part is in electrical contact with the substrate core wire contact part in the first receptor penetration slot, the receptor shielding terminal being in electrical contact with the substrate shielding loop;

the cable end shielding terminal is in electrical communication with the receptor shielding terminal, the receptor metal cover body and the substrate shielding loop respectively to form a shielding environment, such that the first receptor penetration slot is provided with electrical shielding.

3. The receptor connector as claim 2, wherein the receptor metal cover further has an elastic structure, the elastic structure being located between the receptor metal cover body and the cable end shielding terminal for the receptor metal cover body to be in electrical contact with the cable end shielding terminal, and for providing an elastic force to force electrical contact of the cable central conductor end contact part with the substrate core wire contact part.

4. A high-frequency ultra-fine coaxial RF connection member, including:

a coaxial cable having a cable central conductor and a cable shielding conductor, the cable central conductor and the cable shielding conductor being electrically isolated from each other, the cable central conductor having a cable central conductor body and a cable central conductor end contact part, the cable central conductor end contact part being provided on an end of the cable central conductor body;

a cable end connector having a cable end insulator and a cable end shielding terminal, wherein the cable central conductor body penetrates the cable end insulator, and the cable central conductor end contact part extends out of the cable end insulator; and the cable end shielding terminal comprises a cable end shielding conductor crimping part, the cable end shielding conductor crimping part crimping the cable shielding conductor and being in electrical contact with the cable shielding conductor;

a receptor connector having a receptor insulator, a receptor shielding terminal and a receptor metal cover, wherein the receptor insulator has a first receptor penetration slot and a second receptor penetration slot in communication with each other;

the receptor shielding terminal has a first receptor shield and a second receptor shield, the first receptor shield being provided on a slot wall of the first receptor penetration slot to provide electrical shielding for the first receptor penetration slot; the second receptor shield is provided on a slot wall of the second receptor penetration slot, and is in electrical contact with the cable end shielding conductor crimping part to, together with the cable end shielding conductor crimping part, provide electrical shielding for the first receptor penetration slot where the first and the second receptor penetration slots are in communication with each other;

the receptor metal cover has a receptor metal cover body, a receptor cover raise structure and a receptor cover fastening structure, the receptor cover raise structure can lift the receptor metal cover body for the cable central conductor end contact part to be capable of penetrating into the first receptor penetration slot, and for the cable end shielding conductor crimping part to be capable of penetrating into the second receptor penetration slot, the receptor cover fastening structure can fasten the receptor insulator or the receptor shielding terminal for the receptor metal cover body to be in electrical contact with the receptor shielding terminal; and a circuit substrate having a substrate core wire contact part and a substrate shielding loop, the substrate core wire contact part and the substrate shielding loop being electrically isolated from each other, the substrate shielding loop surrounding the substrate core wire contact part, the cable central conductor end contact part being extended toward the substrate core wire contact part, and being in direct electrical contact with the substrate core wire contact part in the first receptor penetration slot, the receptor shielding terminal being in electrical contact with the substrate shielding loop; the cable end shielding terminal being in electrical communication with the receptor shielding terminal, the receptor metal cover body and the substrate shielding loop, respectively, to form a shielding environment, such that the first receptor penetration slot is provided with electrical shielding.

5. The high-frequency ultra-fine coaxial RF connection member as claim 4, wherein the cable end shielding terminal further has a cable end wing-like plate, the cable end wing-like plate being embedded in the receptor insulator to stop movement of the cable end shielding terminal relative to the receptor insulator.

6. The high-frequency ultra-fine coaxial RF connection member as claim 4, wherein the cable end shielding terminal further comprises a cable end insulator support part, the cable end insulator support part extending along an outer wall of the cable end insulator, and embracing the cable end insulator to provide support for the cable end insulator.

* * * * *